US005169108A

United States Patent [19]

Carlson

[11] Patent Number: 5,169,108

[45] Date of Patent: Dec. 8, 1992

[54] CARD TABLE MOUNTED FOOD AND BEVERAGE HOLDING APPARATUS

[75] Inventor: Arthur E. Carlson, 4444 W. Point Loma Blvd. No. 6, San Diego, Calif. 92107

[73] Assignee: Arthur E. Carlson, San Diego, Calif.

[21] Appl. No.: 701,473

[22] Filed: May 16, 1991

[51] Int. Cl.[5] ..... A47K 1/09

[52] U.S. Cl. ..... 248/311.2; 248/315; 248/230

[58] Field of Search ..... 248/311.2, 314, 315, 248/309.1, 310, 312, 312.1, 231.8, 230; 220/475, 85 H; 108/24, 25, 26; 297/88

[56] References Cited

U.S. PATENT DOCUMENTS

| | | | |
|---|---|---|---|
| 2,614,782 | 10/1952 | Jackson | 248/221 |
| 2,703,277 | 3/1955 | Henschel | 311/103 |
| 2,706,138 | 4/1955 | Luce et al. | 311/77 |
| 2,982,982 | 5/1961 | Swift, Sr. | 248/311.2 X |
| 2,995,333 | 8/1961 | Pazzano | 248/311.2 X |
| 3,021,106 | 2/1962 | Kramer | 248/226 |
| 3,131,899 | 5/1964 | Luhrs | 108/26 X |
| 3,270,694 | 9/1966 | Wallace | 108/26 |
| 3,784,142 | 1/1974 | O'Brien | 248/311 |
| 4,099,470 | 7/1978 | Cannon, Jr. | 108/26 |
| 4,131,259 | 12/1978 | Franks | 248/311.2 |
| 4,560,128 | 12/1985 | Willeby | 248/230 |
| 4,799,638 | 1/1989 | Allen | 248/311.2 |
| 4,844,399 | 7/1989 | Harm | 248/311.2 |
| 4,871,141 | 10/1989 | Chen | 248/231.8 X |
| 4,878,642 | 11/1989 | Kirby, Jr. | 248/311.2 |
| 4,887,784 | 12/1989 | Kayali | 248/311.2 |
| 4,997,156 | 3/1991 | Allen | 248/314 X |
| 5,014,956 | 5/1991 | Kayali | 248/311.2 |

*Primary Examiner*—Ramon O. Ramirez
*Attorney, Agent, or Firm*—Baker, Maxham, Jester & Meador

[57] ABSTRACT

A food and/or beverage holder for mounting on a card table includes a food or beverage platform or a beverage container receptacle mounted radially to a base sized to separate the holder far enough from a hook extension, for sanitary reasons, the base being mounted radially from its other end to a table receptacle for providing vertical stability, and from the base or table leg receptacle, a hook which extends axially upwardly therefrom for removable attachment to one or more of the table leg lateral projections. The beverage holder may be removably constructed for separating a major horizontal member from the remainder of the apparatus, to enhance portability.

32 Claims, 6 Drawing Sheets

FIG. 1
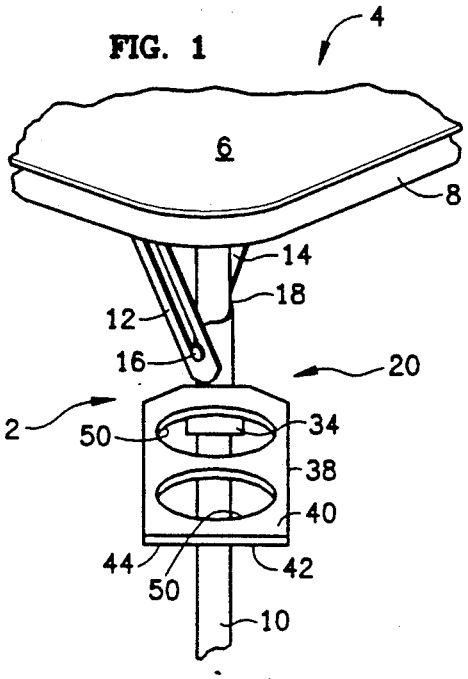
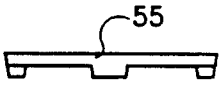
FIG. 4A
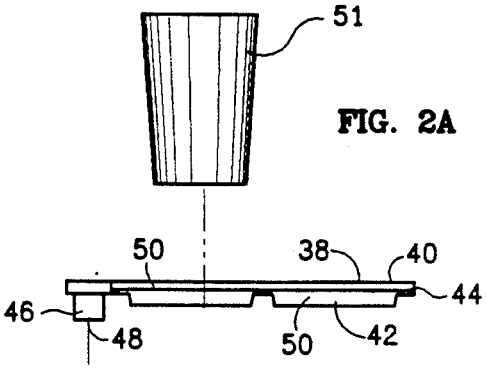
FIG. 2A
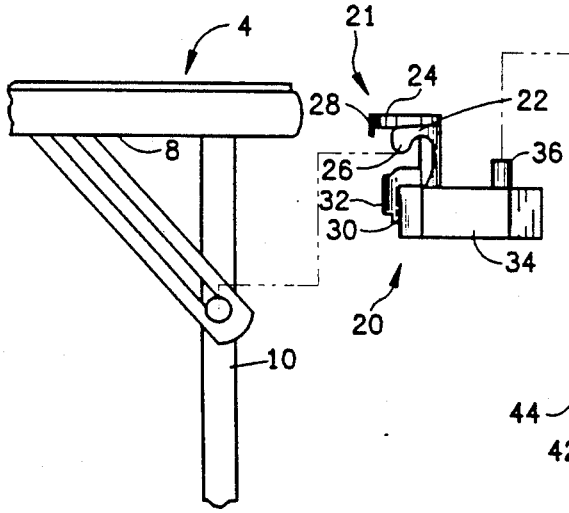
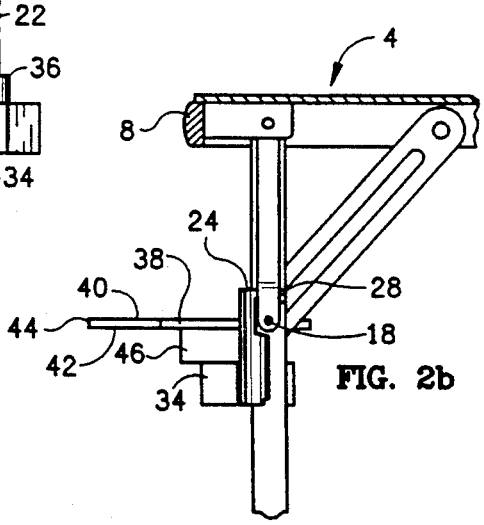
FIG. 2b
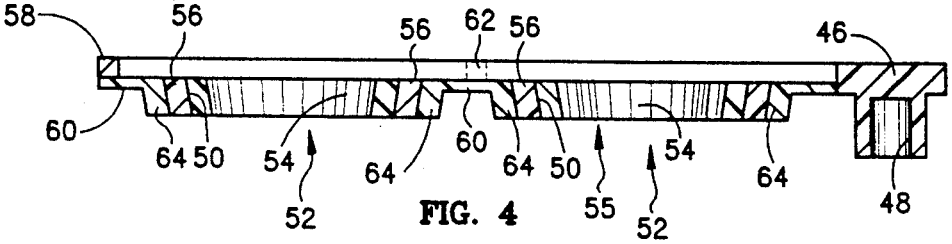
FIG. 4

FIG. 5
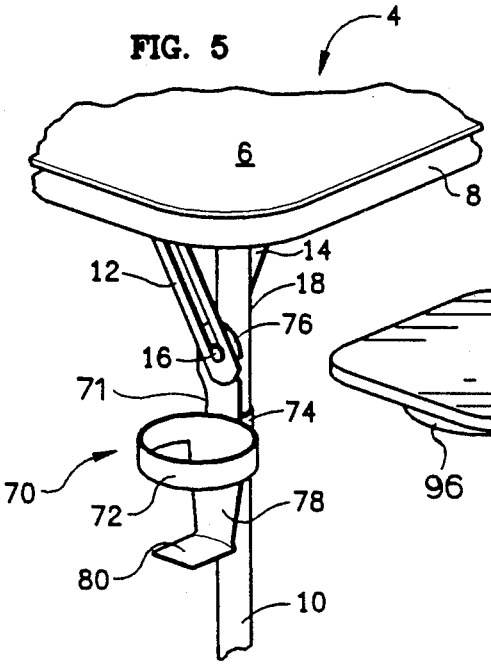
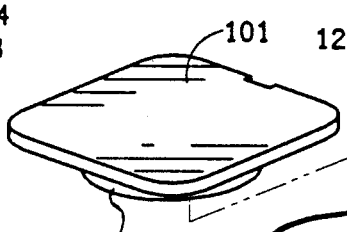
FIG. 6
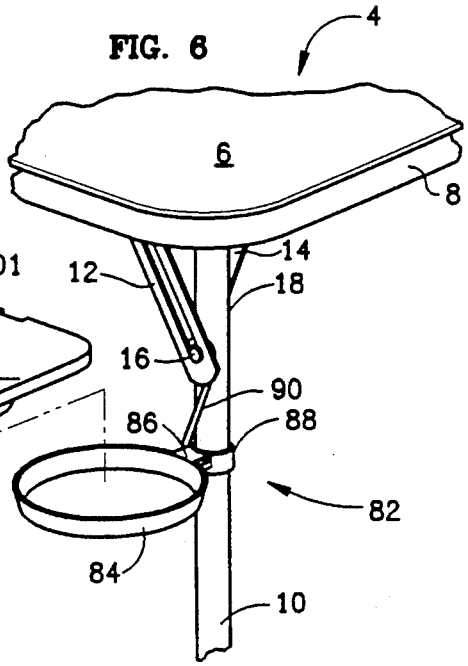
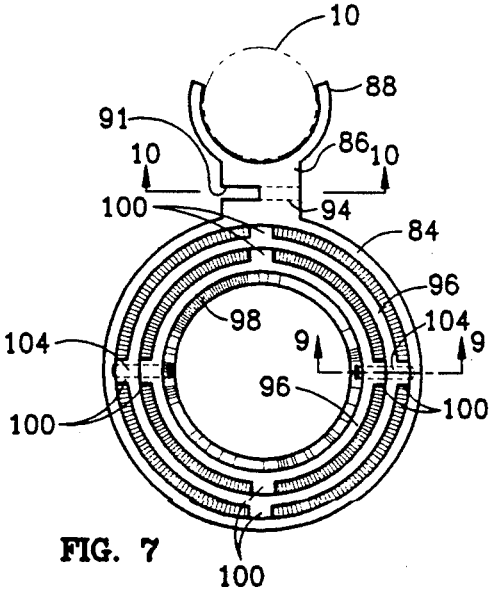
FIG. 7
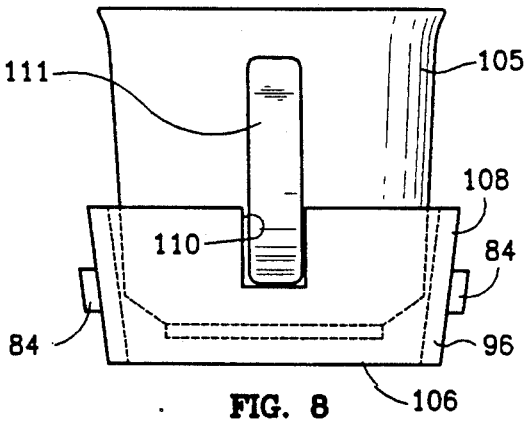
FIG. 8
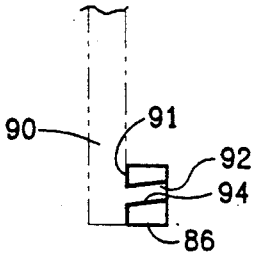
FIG. 10
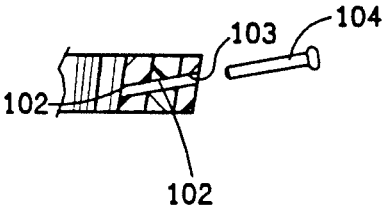
FIG. 9

FIG. 15
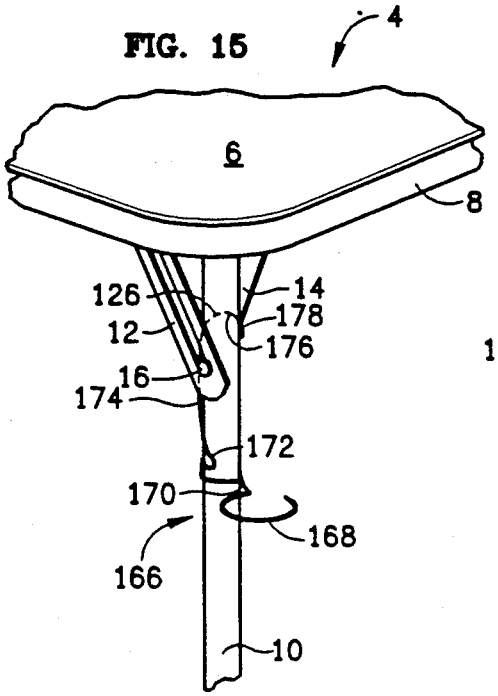
FIG. 18
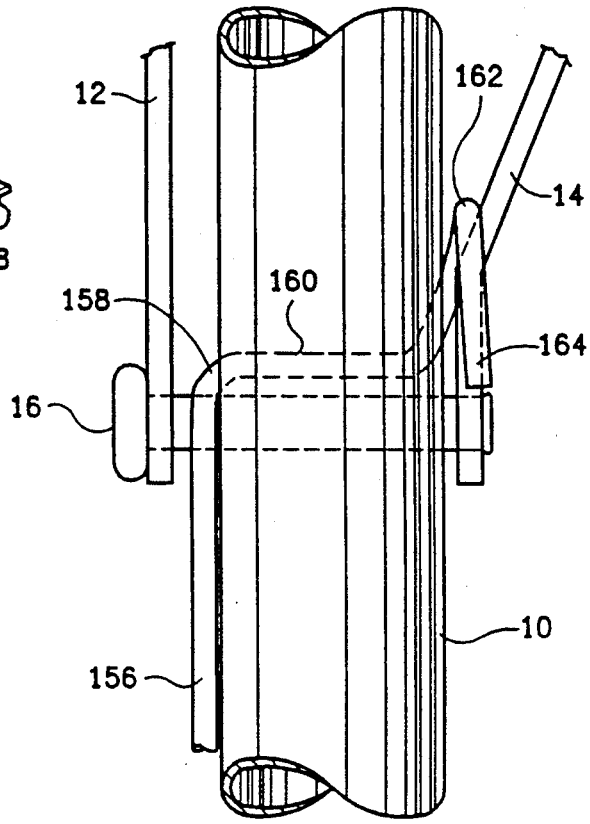
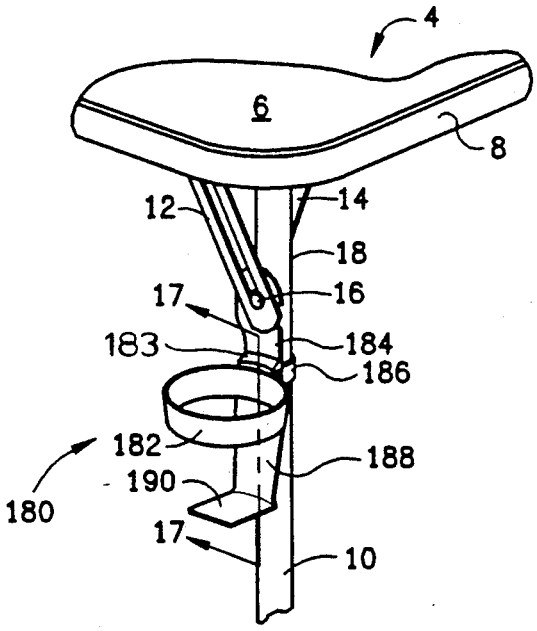
FIG. 16
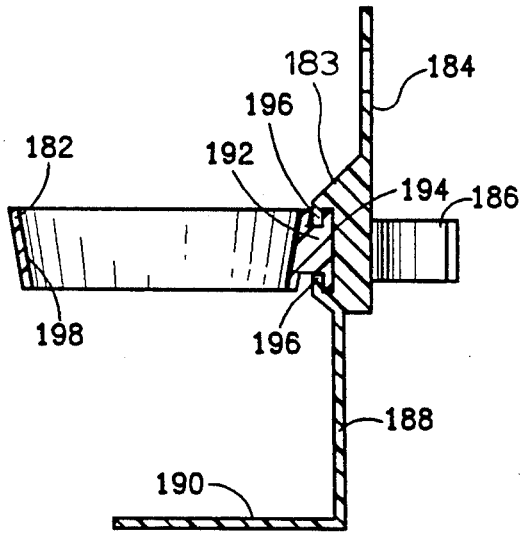
FIG. 17

CARD TABLE MOUNTED FOOD AND BEVERAGE HOLDING APPARATUS

BACKGROUND OF THE INVENTION

The field of the present invention is card table mounted food and beverage holding apparatus.

Folding tables for playing cards and other games are sized and configured to seat a number of persons around the table and include a smooth planar plane area accessible by each of the players. Such tables generally have four legs which are positionable between a stowage position and an open playing position. Typical card tables include a slotted brace member and a pivotable strut member for supporting each leg in the open position.

Because card games are often of fairly long duration, players often consume food and beverages, or smoke cigarettes, while playing. Because the table playing surface area is fairly limited, the placement of consumables on the table can result in spillage or other damage to the cards and the table.

Accordingly, it would be desirable to provide a holder for supporting food and beverages consumed by players at a card table which is readily accessible to the players but which eliminates the possibility of spillage and other damage. It would be further desirable to provide a food and beverage holder which can be readily removed from the table and transported with a player from one site to another. Relatedly, the food and beverage holder should not interfere in any way with table stowage following card play.

SUMMARY OF THE INVENTION

It is therefore the primary object of the present invention to provide a food and beverage holder for a card table directed to the foregoing objects and advantages. To that end, a removable card table mounted food and beverage holder may include in a preferred aspect a food or beverage holding member radially connected to a base, with the other end of said base connected to a table leg receptacle with its upper most portion being connected to a rising extension which ends with a hook for connection to one or more of the table leg support structures.

BRIEF DESCRIPTION OF THE DRAWINGS

FIG. 1 is a perspective view of a food and beverage holder constructed in accordance with the present invention as it would appear mounted on a collapsable card table.

FIG. 2A is an exploded side elevation view of the food and beverage holder of FIG. 1 showing a cup to be held thereby.

FIG. 2B is a reverse angle elevation view of the beverage holder of FIG. 2A.

FIG. 4 is a cross-sectional view taken along line 4—4 in FIG. 3.

FIG. 4A is an end view of an insert adapted for use with the food and beverage holder of FIG. 1.

FIG. 5 is a perspective view of a food or drink holder constructed in accordance with another aspect of the present invention as mounted on a collapsable card table.

FIG. 6 is a perspective view of a food or beverage holder constructed with still another aspect of the present invention as mounted on a collapsable card table.

FIG. 7 is a plan view of the food or beverage holder of FIG. 6.

FIG. 8 is a side elevation view of a beverage holding insert for the food or beverage holder of FIG. 6 shown with a beverage mug and supported therein.

FIG. 9 is a detailed cross-sectional view taken along line 9—9 in FIG. 7.

FIG. 10 is a detailed cross-sectional view taken along line 10—10 in FIG. 7.

FIG. 15 is a perspective view of a food or beverage holder constructed in accordance with still another aspect of the present invention as mounted on a collapsable card table.

FIG. 16 is a perspective view of a food or beverage holder constructed in accordance with still another aspect of the present invention as mounted on a collapsable card table.

FIG. 17 is a detailed cross-sectional view taken along line 17—17 in FIG. 16.

FIG. 18 is a detailed side-elevation view of the food or beverage holder of FIG. 14.

FIG. 10 is a detailed plan view of the food or beverage holder of FIG. 19.

DESCRIPTION OF THE PREFERRED EMBODIMENTS

Figure 3:
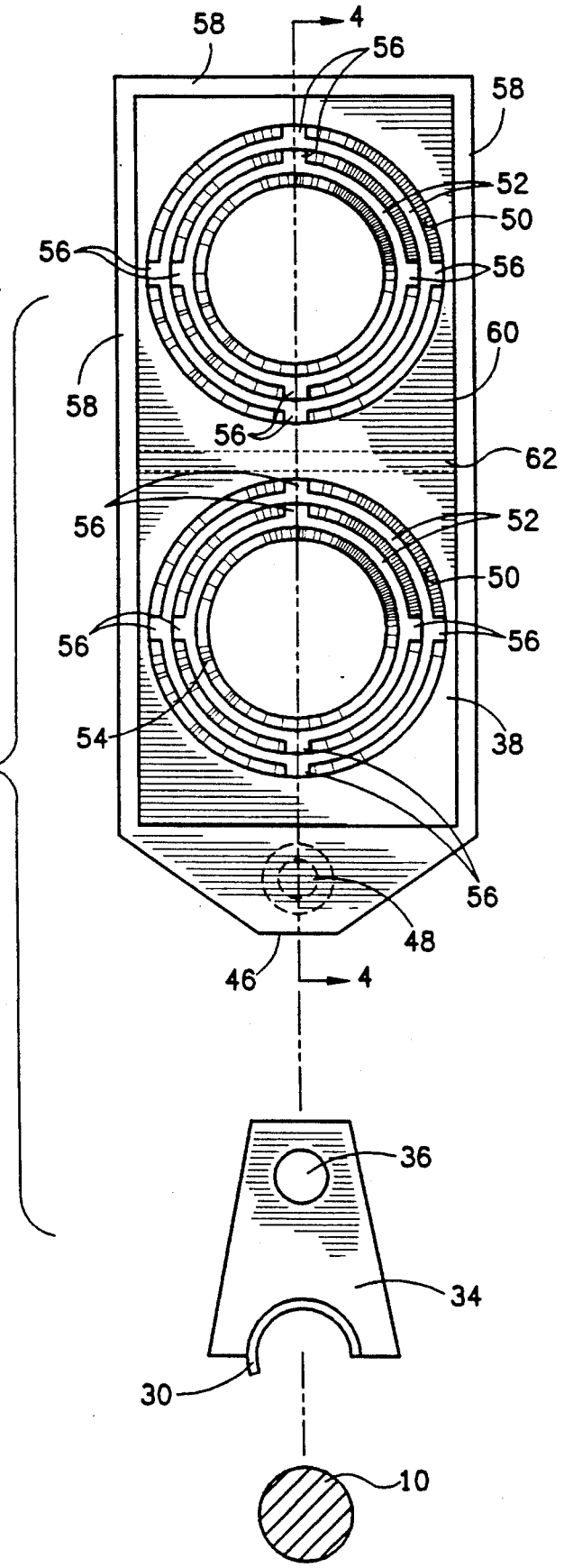
FIG. 3 is a plan view of a portion of the food and beverage holder of FIG. 1.

With reference now to FIGS. 1 and 2A, 2B, a food or beverage holder 2 is shown as being mounted on a collapsable card table 4, which is set up in playing position. The collapsable card table 4 includes a generally planar table top 6 having a peripheral railing 8. Extending generally perpendicularly and downwardly from the underside of the table top 6 is a table leg assembly including a leg 10, which is one of four legs used to support the table top 6 in an upright, horizontal playing position. The table leg 10 is stablized and supported in the open position by means of a slotted support 12 and a stablizing strut 14. The table leg 10 is slidably disposed in the slotted support 12 by means of a laterally extending projection 16 having an enlarged end portion that is spaced laterally from the table leg 10. Typically, the projection 16 would be formed from a bolt having a rivet-like head. The lower end of the slot formed in the slotted support 12 is an enlarged circular opening whose diameter is larger than the width of the slot. The projection 16 extending from the table leg 10 includes an area of enlarged diameter disposed inside the enlarged end portion which engages the circular opening so as to lock the table leg 10 and slotted support 12 in a secured relation. The upper end of the slotted support 12 is pivotally mounted to the underside of the table top 6. To collapse the table leg 10, the slotted support 12 is pressed toward the leg so that the enlarged slot end disengages from the enlarged diameter section of the projection 16, whereupon a smaller diameter section of the projection 16, adjacent the table leg 10, can be slidably translated through the slot in the slotted support 12.

The stablizing strut 14 is pivotally mounted at one end to the underside of the table top 6, and at the other end to the table leg 10, on the side opposite the projection 16. Typically, the stablizing strut is mounted to the table leg 10 somewhat above the level of projection 16. The stablizing strut 14 is partially attached to the table leg 10 by means of a rivet or other suitable fastener 18.

In the configuration of FIGS. 1 and 2A, 2B, the slotted support 12 is positioned to the right side of a player seated at the side of the card table 4 to which the slotted support 12 is attached. In some table configurations, the slotted support 12 is positioned on the player's left. It should be understood and appreciated that the food and beverage holders now to be described could be readily adapted to both configurations, or to other table configurations conventionally used.

The food or beverage holder 2 includes an attachment at 20 with arms 30 and 32 forming a table leg receptacle of generally cylindrical shape but open on one side to amount over the table leg 10. The arms 30 and 32 of the table leg receptacle extends more than 180 degrees around the table leg 10 and is in non-grasping the engagement with the table leg 10. The attachment 21 has a hook or two hooks which extend upwardly from the attachment at 20 and are adapted for mounting onto two table leg lateral projections, bolt 16 and strut 14. To that end, the hooks includes a first cutout therein forming an arm 22 and a diametrically opposed cutout forming an arm 24. The arm 22 is sized to engage the table leg projection 16. The arm 24 is slightly wider and is sized to engage the stablizing strut 14. The arms 22 and 24 terminate at opposing attachment hooks 26 and 28, respectively. A variation is where there is no arm 24 and it does not mount onto strut 14 but arm 26 mounts on projection 16. Relatedly, the inside diameter of the table leg receptacle made by the arms 30 and 32 is slightly larger than the diameter of the table leg 10, thus guaranteeing that said table leg receptacle does not have a grasping hold on table leg 10. The components of attachment 20 and 21 are preferably formed from resilient plastic or the like so that the attachment hooks 26, 28 and arms 30, 32, when they exceed 180 degrees, may be flexed outwardly as the food or beverage holder 2 is engaged or disengaged with the table leg 10.

The table leg attachment at 20 is integral with the base 34 which extends radially away from the table leg receptacle at 20 and toward the platform 38. The base 34 includes a pivotal connection 36 mounted adjacent one end thereof and extending vertically therefrom. The pivotal connection 36 is used to mount the base 34 to a food or beverage holding platform 38 at 46. The food or beverage platform 38 includes an upper surface 40, a lower surface 42, a plurality of sides 44 and a connection stem 46 disposed at one end thereof. The connection stem 46 has formed therein a cylindrical recess 48 sized and adapted to receive the pivotal connection 36 of the base 34. The food or beverage holding platform 38 further includes a pair of cupholding aperatures 50 that are sized and adapted to receive a beverage container 51. The foregoing components could be made from a variety of materials but are preferably formed from resilient plastic having sufficient strength to bear the weight of food and beverages without excessive deformation or instability. The base 34, referred to above, is located between the beverage holding platform 38 and the table leg attachment 20. One of its functions is to separate those adjoining members by adequate space so the drinking ring of the beverage container will not contact the hook extensions of the table leg attachment 20 or the slotted support 12 during normal use.

In operation, the food or beverage holding platform 38 can be used to hold a beverage container 51 for each of two players, one sitting on either side of the table leg 10. The players can pivot the holding platform 38 with respect to the table leg attachment 20 so as to have better access to the supported beverage.

Referring now to FIGS. 3 and 4, the food or beverage platform 38 may be adapted to support beverage and containers of varying size using one or more nested inserts 52. Each insert 52 includes an annular ring portion having an interior beverage container support surface 54 tapering downwardly and inwardly from the top of the retainer 52. The nested retainers 52 further include four radially extending spacers 56 positioned on the exterior of the annular ring portion of the retainers. The spacers 56 are sized to engage the innersurface 54 of the next larger spacer ring 52 or the aperature 50 of the food or beverage platform 38, depending on the size of the retainer ring 52.

As further shown in FIG. 3, the food or beverage holding platform 38 may include a perimeter wall 58 extending around a central web 60. In addition, there may be provided a central flange 62 that divides the holding platform 38 into two compartments. As further shown in FIG. 4, the food or beverage holding aperatures 50 in the holding platform 38 are formed by a pair of flanges 64 extending downwardly and inwardly from the web 60.

Shown in FIG. 4A is an insert 55 to fill the space between the pair of flanges 64 furthest from recess 48 of FIG. 4, with its top surface flush with web 60 for holding cookies, ash tray, etc., for the situation when all four table legs 10 have a food or beverage holder 2 and each of the four players only needs one aperture for a beverage. The lower perimeter wall portions of insert 55 preferably extend down as far as possible as the wall 64 of the receptacle 50 for proper seating. Moreover, the top circular surface of insert 55 is preferably as thick as and is flush with the top of the web 60 of the holding platform 38.

Turning now to FIG. 5, a beverage holder 70 is shown mounted on the collapsable card table 4 of FIG. 1. The beverage holder 70 includes a base 71 and a generally ring shaped beverage container receptacle 72 mounted to the base 71, the axial and radial geometry of which shall be used in reference to the remaining components of the holder 70. A table leg receptacle 74 is mounted to and extends radially away from the base 71 to encompass a portion of the card table leg 10. The table leg receptable 74 extends partially around the table leg 10 for a distance slightly more than 180 degrees, and has an inside diameter slightly in excess of the outside diameter of the table leg 10 to provide engagement therewith. As in the case of the food or beverage holder 20, the beverage holder 70 is preferrably made from resilient plastic material. The receptacle 74 thus is deformable as the receptacle is engaged or disengaged with the table leg. The beverage holder 70 further includes an attachment hook 76 extending axially upwardly from the base 71 for engaging the projection 16 extending laterally from the card table leg 10. Preferrably, the attachment hook 76 is curved to conform to the outside curvature of the table leg 10. The beverage holder 70 is completed by a leg member 78 extending axially downwardly from the base 17, and a beverage container support foot 80 extending radially away from the leg member 78, toward the axis of the beverage container receptacle 72.

Referring now to FIG. 6, another beverage holder 82 is shown mounted on the table 4 of FIG. 1. The beverage holder 82 includes a generally ring-shaped beverage container receptacle 84, the axial and radial orientation of which shall be used in reference to the remaining components of the holder 82. The beverage container receptacle 84 is integrally formed with base 86 and table leg receptacle 88 extending radially away from the base 86 for encompassing slightly more than 180 degrees of the card table leg 10. Extending upwardly from the base 86, is an attachment hook 90 for engaging from its left or right side the projection 16 extending laterally from the card table leg 10. As shown in FIG. 10, the attachment hook 90 at its bottom end is received in a slot 91 in the base 86 and includes an engagement pin 92 extending laterally and slightly upwardly from a position near the bottom of the hook 90. The engagement pin 92 is sized and adapted to engage a mating receptacle 94 extending from the right side of the slot 91 to the right side of the base 86 of the beverage holder 82. Thus, these integral parts of the beverage container receptacle 84, the table leg receptacle 88 and base 86 can be disengaged from the attachment hook 90, as shown in FIGS. 7 and 10, for convenient transport, storage of the holder and simplification of dies for plastics molding of holder 82.

Referring now to FIGS. 7 and 8, the beverage holder 82 may include a plurality of nested adapter rings 96 which are identical in design to the adapter rings 52 described above. Thus, the adapter rings 96 include an annular body portion having an interior surface 98 extending downwardly and inwardly from the top of the annular body portion to support a beverage container. Extending radially outwardly from the annular body portion of the adapter rings 96 are four spacers 100. These spacers 100 are sized to nest within the interior of the beverage container receptacle 84 or the interior face 98 of the next larger adapter ring 96, depending on the size of the ring 96. As shown in FIG. 6, the adapter ring 96 could be provided with an upper support tray 101. The support tray 101 could be provided in a variety of shapes and sizes, but preferably should be large enough relative to the ring 96 to extend over and beyond the beverage container receptacle 84 to adapt the beverage holder 82 for supporting food, ashtray, or other items in addition to a beverage.

To help secure the adapter rings 96 in position within the beverage container receptacle 84, the rings are provided with coincident radially extending apertures 102 which may be coincidentally aligned to receive a locking pin 104 with handle at its end for removal and to prevent it from entering too far, as shown in FIG. 9. As shown, the beverage container receptacle 84 includes a similar radially extending aperature 103 for receiving the locking pin 104. The foregoing components of the beverage holder 82 are preferably formed from suitable strength resilient plastic.

As shown in FIG. 8, one of the nested adapter rings 96 may be elevationally elongated to provide support for a mug 105. In that case, the adapter ring 96 would further include a generally frustoconical (or annular) wall 108 having a notch 110 formed therein to receive the mug handle 111.

Figure 11:
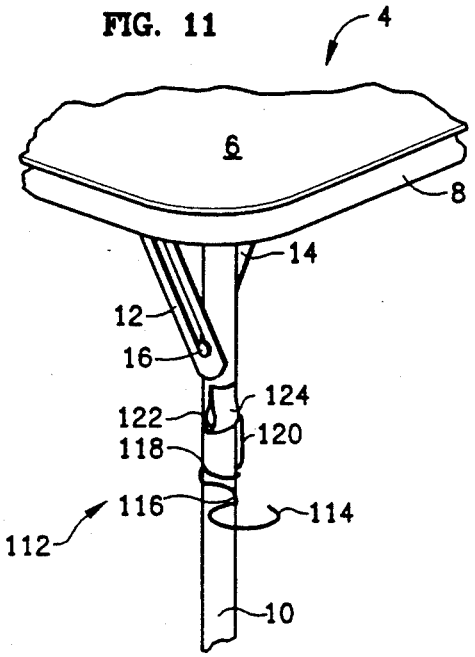
FIG. 11 is a perspective view of a food or beverage holder constructed in accordance with still another aspect of the present invention as mounted on a collapsable card table.

The beverage holders of FIGS. 11, 12, 13, 14, and 15 are shown as though the beverage containers, when in use, would be 25 degrees to 40 degrees to the right of bolt 16 and slotted support 12. In drawing these figures, the characteristics of the beverage holders were of primary concern. In actual use, the perpendicular centerlines of these beverage holders would extend down from bolt 16 so the beverage containers would be as convenient as possible to a card player's right hand. Turning now to FIG. 11, a beverage holder 112, which may be made from steel or the like, is shown mounted on the card table 4. The beverage holder 112 includes a ring-shaped beverage container receptacle 114 extending from a base 116. Also extending from the base 116, opposite the beverage container receptacle 114, is a table leg receptacle 118. The table leg receptacle 118 is adapted to fit snugly around the table leg 10 and extends more than 180 degrees around the table leg so as to provide an attachment therewith. Extending upwardly from the receptacle 118 is a vertical extension 120 extending to a hook 122. The hook 122 is curved to extend partially around the table leg 10 and is adapted to be received in a supporting loop 124 mounted to the table leg 10. If the beverage holder 112 is formed from steel and provides the aforementioned structural aspects, it will then have to be treated to obtain the resiliency required. The support loop 124 is preferably a strip of material folded over on itself to form the loop. The loop 124 is adhered on one side to the table leg 10, directly below the bolt 16.

Figure 12:
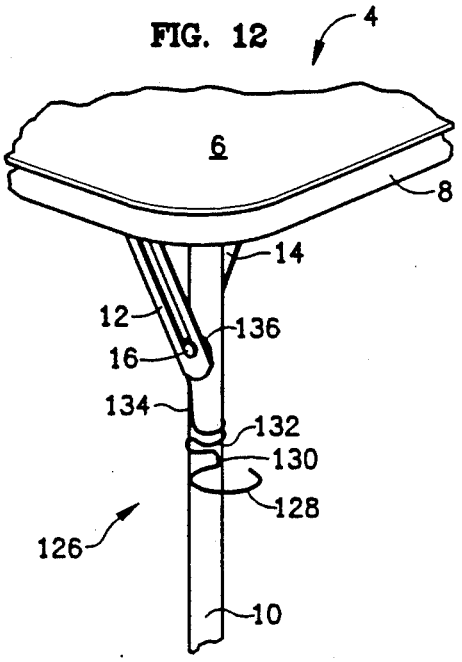
FIG. 12 is a perspective view of a food or beverage holder constructed in accordance with still another aspect of the present invention as mounted on a collapsable card table.

Turning now to FIG. 12, a beverage holder 126, made from steel or the like, is mounted on the card table 4. The beverage container 126 includes a lower beverage container receptacle 128 attached to a base 130. Extending from the base 130, opposite the beverage container receptacle 128, is a table leg receptacle 132. The table leg receptacle 132 is similar to the receptacle 118, previously described. Extending upwardly from the receptacle 132 is a vertical extension 134 extending to a hook 136 that is sized and adapted to engage the lateral projection 16 of the table leg 10. The beverage holder 126 may be formed from steel to provide the aforementioned characteristics and is then treated to provide the resiliency desired.

Figure 13:
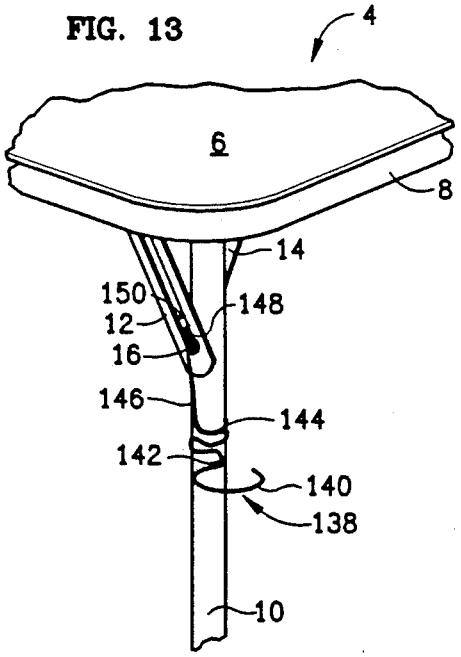
FIG. 13 is a perspective view of a food or beverage holder constructed in accordance with still another aspect of the present invention as mounted on a collapsable card table.

Referring now to FIG. 13, a beverage holder 138, made from steel or the like, includes a lower beverage container receptacle 140 attached to a base 142. Extending from the base 142, opposite the beverage container receptacle 140, is a table leg receptacle 144 which is similar to the table leg receptacle 132 previously described. Extending upwardly from the table leg receptacle 144 is an upward extension 146 extending to a hook 148. The hook 148 is sized and adapted to fit through the slot in the slotted support member 12 of the table 4 and includes an enlarged loop end portion 150 to prevent the beverage holder 138 from disengaging from the table 4. Holder 138 may be formed from steel after which it will be treated to provide the resiliency desired.

Figure 14:
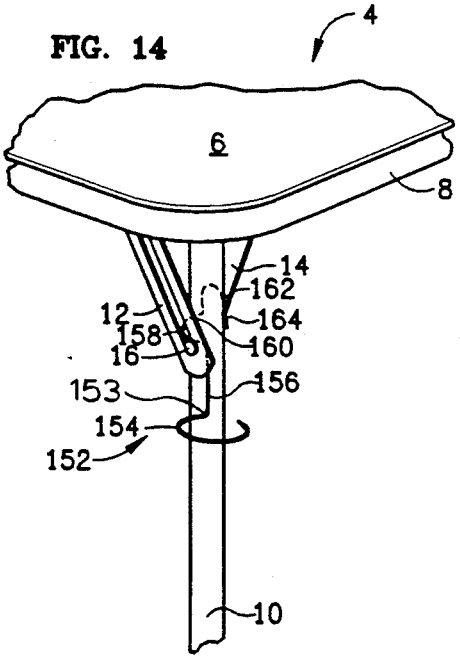
FIG. 14 is a perspective view of a food or beverage holder constructed in accordance with still another aspect of the present invention as mounted on a collapsable card table.

FIG. 14 shows a beverage holder 152, also made from steel or the like, mounted on the card table 4. The beverage holder 152 has a lower beverage container receptacle 154, with a base 153 extending radially therefrom to meet the bottom of an upward extension 156. Extending upwardly from the base 153 is the upward extension 156 passing the right side of the lateral projection 16, then turning left into a shoulder 158. The shoulder 158 is sized and adapted to rest atop the lateral projection 16. Extending from the shoulder 158 is a horizontal table leg receptacle 160 that is sized and adapted to wrap around the left side of table leg 10 at a location above the lateral projection 16. The table leg receptacle 160 includes a second vertical extension 162 that engages the support strut 14 by means of a hook 164. Holder 152 may be formed from steel, after which it will be treated to provide the resiliency desired. FIG. 18 is an enlarged view of a portion of the above and is discussed in more detail below.

Referring now to FIG. 15, a beverage holder 166, made from steel or the like, is mounted to the card table 4. The beverage holder 166 includes a lower beverage container receptable 168 mounted to a base 170. Also mounted to the base 170, opposing the beverage container receptacle 168, is a table leg receptacle 172. Extending vertically upwardly from the table leg receptacle 172 is an upward extension 174 passing to the left of bolt 16 and transitioning to an upper shoulder 176. The shoulder 176 is sized and adapted to wrap about one half way around the table leg 10 on the left side and includes a hook 178 that is sized and adapted to engage the support strut 14 of the table 4. After being formed as mentioned, a steel holder 166 would be treated to provide the resiliency required.

Referring now to FIG. 16 and 17, a beverage holder 180 is mounted to the collapsable card table 4. The beverage holder 180 is similar in some respects to the beverage holder 70 except that the beverage container receptacle 182 is removably mountable a base 183 which is attached on its other side to a table leg receptacle 186, and to the upwardly extending hook 184 to the hook and base portion of the receptacle 182 tapers downwardly and inwardly at an angle similar to that of the containers holder 180 is designed to receive. Otherwise, the beverage holder 180 includes a table leg receptacle 186 extending outwardly from the base 183. A lower vertical extension 188 from base 183 connects with the horizontal beverage container support member 190. The beverage container receptacle 182 includes a stem 192 extending radially outwardly therefrom having an attachment tab 194 thereon. The base 183 includes a pair of upper and lower opposing arms 196 spaced to secure the attachment tab 194 for removable attachment therebetween by radially rotating the beverage container receptacle 182 to slidably bring the attachment tab 194 in and out of engagement with the opposing arms 196. As shown, the beverage container receptacle 182 may have an interior face 198 that extends downwardly and inwardly from the top of the receptacle 182 to provide enhanced support for a beverage container. By having three removable beverage container receptacles 182 of increasingly bigger diameters, an assortment of tapered plastic or paper beverage containers can be held which have capacities ranging from 6 to 15 ounces. An equally useful variation to the above-described stem 192 which extends radially outwardly from the beverage container receptacle 182 follows. The stem 192 could be straight side to side, being perpendicular to a line passing from a line which starts at the outermost point of container 182, then through the center of receptacle 182 and to the center of the base 183 and the stem would be slidable in a straight tunnel-like opening extending from one side of the base 183 to the other. The base 183 would have a pair of upper and lower opposing arms 196 spaced to secure the attachment tabs 194, for removable attachment therebetween by sliding stem 192 through the straight tunnel-like opening in the base 183. The base 183 should be sized large enough so that its separation of the container receptable 182 from the table leg receptacle 186 is sufficient so that the drinking ring of a large tapered cup during actual use, does not, with normal care, contact the hook 184, its lower extension or the table leg slotted support 12, for sanitary reasons. In other respects, this variation would be like beverage holder 180 described above.

FIG. 18 is an enlarged view of FIG. 14 with respect to reference numbers 156, 16, 158, 160, 162, 14 and 164. As shown, the first upward extension 156 passes over the lateral projection 16 and transitions to a shoulder 158, which rests on top of the projection 16. The shoulder 158 transitions to a partial table leg receptacle 160, which in turn includes a second upward extension 162 terminating at the hook 164, engaging the strut 14.

Figure 19:
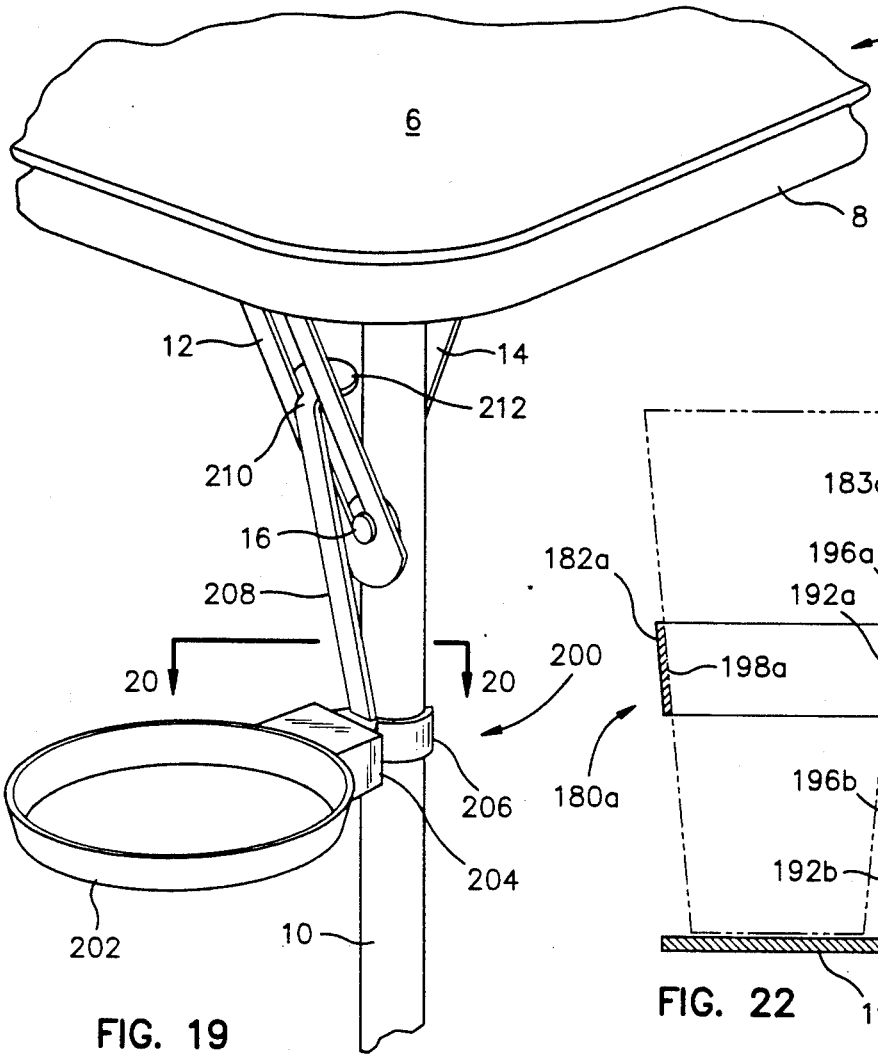
FIG. 19 is a perspective view of a food or beverage holder constructed in accordance with previously described aspects of the present invention and mounted on a collapsible card table.

Referring now to FIG. 19, a beverage holder 200, made from any suitable resilient material such as plastic, steel or the like, includes a lower beverage receptacle 202 attached to a base 204. Extending from the base 204, opposite the beverage container 202, is a table leg receptable 206, which is similar to the table leg receptacle 186 previously described. Extending upwardly from the table leg receptacle 206 is an upward extension 208, extending to a hook 210. The hook 210 is sized and adapted to fit through the slot in the slotted support member 12 of the table 4 and includes an enlarged end portion 212 to prevent the beverage holder 200 from disengaging from the table 4.

Figure 21:
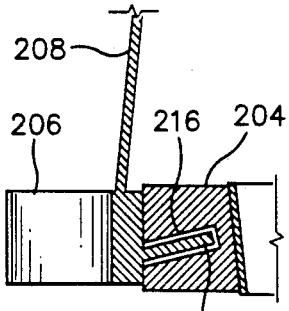
FIG. 21 is a detailed cross sectional view taken along line 21—21 in FIG. 20.
Figure 20:
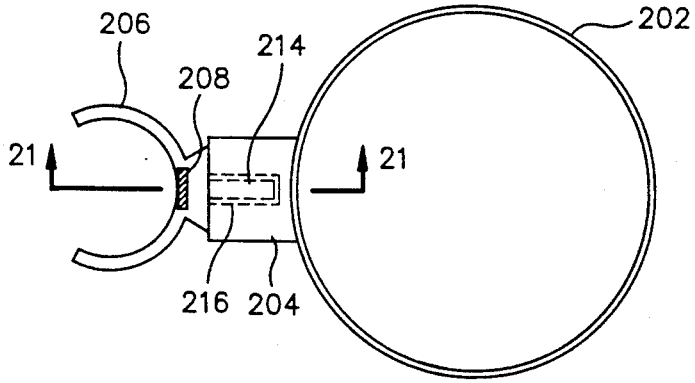

FIG. 20 illustrates the beverage holder 200 in plan view orientation. As shown therein, the table leg receptacle 206 includes an engagement pin 214 which is sized and adapted to engage a mating receptacle 216 commencing from the left side of the base 204 and extending upwardly and toward the beverage container receptacle 202. This configuration is illustrated in side view orientation in FIG. 21.

Figure 22:
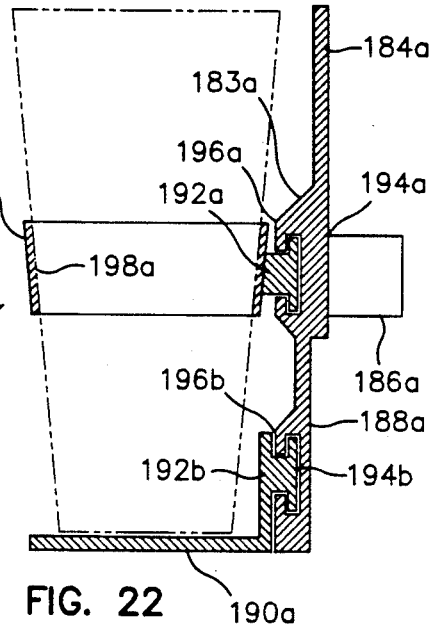
FIG. 22 is a partial cross sectional view of a food or beverage holder constructed in accordance with previously described aspects of the present invention.

Referring now to FIG. 22, a slight modification of the beverage container of FIGS. 16 and 17 is shown as including a beverage holder **180*a*. The beverage holder 180*a* is similar in some respects to the beverage holder 70 except that the beverage container receptacle 182*a* is removably mountable to a base 183*a* which is attached on its other side to a table leg receptacle 186*a* and to an upwardly extending hook 184*a*. The beverage container receptacle 182*a* tapers downwardly and inwardly at an angle similar to that of the containers holder 180*a* is designed to receive. Otherwise, the beverage holder 180*a* includes a table leg receptacle 186*a* extending outwardly from the base 183*a*. A lower vertical extension 188***a* from the base 183*a* connects with a horizontal beverage container support member 190*a*. The beverage container receptacle 182*a* includes a stem 192*a* extending radially outwardly therefrom having an attachment tab 194*a* thereon. The base 183*a* includes a pair of upper and lower opposing arms 196*a* spaced to secure the attachment tab 194*a* for removable attachment therebetween by radially rotating the beverage container receptacle 182*a* to slideably bring the attachment tab 194*a* in and out of engagement with the opposing arms 196*a*. As shown, the beverage container receptacle 182*a* may have an interior face 198*a* that extends downwardly and inwardly from the top of the receptacle 182*a* to provide enhanced support for a beverage container.

The beverage container support member 190*a* is removably mounted to the lower vertical extension 188*a* in similar fashion. Thus, the support member 190*a* includes an end portion extending axially upwardly for a short distance, parallel to the thickened bottom portion of the lower vertical extension 188*a*. The vertical portion of the support member 190*a* includes a stem 192*b* extending radially outwardly therefrom having an attachment tab 194*b* thereon. The lower vertical extension 188*a* includes a pair of upper and lower opposing arms 196*b* which form a tunnel within which the stem 194*b* can be removably and slideably retained by the opposing arms 196*b*, providing a capability of removing the support member 190*a* from the lower vertical extension 188*a*.

While I have described several preferred embodiments of my card-table mounted food and beverage holder apparatus, it should be understood that modifications and adaptations thereof will occur to persons skilled in the art. Therefore, the protection afforded my invention should not be limited except in accordance with the spirit of the following claims and their equivalents.

I claim:

1. A food or beverage holder for mounting on a card table leg assembly, comprising:

a food or beverage holder;

a base extending radially from said holder and mounted thereto;

a table leg receptacle mounted to and extending radially from said base, said table leg receptacle being sized to non-graspingly yet closely encompass more than 180 degrees of a card table leg to prevent side to side or front to back beverage movement that would cause beverage spillage;

at least one attachment hook extending upwardly from said leg receptacle for engaging a table leg lateral projection; and said base being sized so that beverage containers will not contact the card table leg assembly or attachment hook during normal use.

2. The food or beverage holder of claim 1 wherein a pair of hooks extend upwardly from said table leg receptacle to engage a pair of table leg lateral projections.

3. The food or beverage holder of claim 2 wherein one of the table leg lateral projections is a bolt with a rivet-like head and the other a table leg support strut.

4. The food or beverage holder of claim 1 wherein said table leg receptacle is configured generally as a cylinder with almost half of its horizontal circumference removed.

5. The food or beverage holder of claim 1 wherein said table leg receptacle is formed of resilient material and extends partially around the circumference of the table leg so as to be resiliently secured thereon.

6. The food or beverage holder of claim 1 wherein said holder and said base are removably mounted to each other.

7. The food or beverage holder of claim 1 wherein said holder and said base are pivotally mounted to each other.

8. The food or beverage holder of claim 1 wherein said holder includes at least one beverage container receptacle extending therethrough.

9. The food or beverage holder of claim 8 wherein there are two beverage container receptacles extending therethrough and one is filled with a removable nesting insert whose perimeter wall extends down as far as the wall of the receptacle and whose top circular surface is as thick as and is flush with the upper surface of the holder to provide space for food or other articles.

10. The food or beverage holder of claim 9 further including one or more nested inserts having an exterior wall portion sized to mount in said beverage container receptacle or in a larger size insert, and further having an interior wall portion sized to support a beverage container.

11. The food or beverage holder of claim 9 further including a mug supporting insert sized to nest in one beverage container receptacle for supporting a mug, said insert being tapered and having a wall, said wall being substantially higher than said container receptacle and including a notch for allowing a mug handle to pass exteriorally thereof.

12. The food or beverage holder of claim 1 wherein said holder is integral with said base, said base also being integral with said leg receptacle, with an attachment hook extending upwardly therefrom to attach to a table leg lateral projection, and said base being separable into two parts.

13. The food or beverage holder of claim 1 wherein said holder, said base or said leg receptacle is separable from a connecting member or wherein any one of said three members is separable within itself such that a major horizontal or vertical dimension of the separated assembly is reduced to simplify transport in a purse or pocket from home to a bridge game or the like.

14. A beverage holder for mounting on a card table leg assembly, comprising:

a generally ring-shaped beverage container receptacle;

a base extending radially away from said container receptacle and mounted thereto;

a table leg receptacle mounted to and extending radially from said base for non-graspingly yet closely encompassing more than 180 degrees of a card table leg to prevent side to side or front to back beverage movement that would cause beverage spillage;

an attachment hook extending upwardly from said base for engaging a portion of the card table leg assembly; and said base being sized so that beverage containers will not contact the card table leg assembly or attachment hook during normal use.

15. The beverage holder of claim 12 further including a leg member extending axially downwardly from said base and ring-shaped beverage container receptacle and said attachment hook, and a beverage container support foot extending radially from said leg member below said beverage container receptacle.

16. The beverage holder of claim 14 wherein said beverage container receptacle is tapered downwardly and inwardly and includes an open bottom to allow passage of a beverage container portion therethrough, and further including one or more tapered nested inserts having an exterior wall portion tapering downwardly and inwardly and sized to mount in said beverage container receptacle, or in a larger sized insert, and an interior similarly tapering wall portion sized to support a tapering beverage container.

17. The beverage container of claim 16 wherein one of said nested inserts includes a planar upper surface extending over and beyond said ring-shaped beverage container receptacle for supporting one or more articles.

18. The beverage container of claim 16 further including one or more pins extending through and removably disposed in said ring-shaped beverage container receptacle and said nested inserts for securing said inserts in said beverage container receptacle.

19. The beverage holder of claim 14 wherein said ring-shaped beverage container receptacle includes a stem extending radially outwardly therefrom having an attachment tab thereon, and wherein said base includes a pair of opposing arms spaced to secure said attachment tab for removable attachment therebetween by slideably positioning said beverage container receptacle to slideably bring said attachment tabs into securement with said opposing arms.

20. The beverage holder of claim 14 wherein said attachment hook is adapted for removably engaging an anchor mounted to a card table leg.

21. The beverage holder of claim 14 wherein said ring-shaped beverage container receptacle is integral with said base and said table leg receptacle and separable from said attachment hook.

22. The beverage holder of claim 14 wherein said attachment hook is removably mounted by an attachment pin extending therefrom into a pin receptacle disposed in said base.

23. The beverage holder of claim 19 further including a first leg member extending axially downwardly from said base and a beverage container support foot extending radially from said leg member below said beverage container receptacle.

24. The beverage holder of claim 23 wherein said first leg member is thicker for its bottom inch of length to provide a pair of opposing arms and a tunnel formed by said arms, said support foot including a second leg member extending axially upwardly for a short distance, parallel to said bottom portion of said first leg member, said second leg member having a stem extending radially outwardly therefrom toward said arms and tunnel, said stem having an attachment tab to be removably and slideably held in said tunnel by the opposing arms, providing a capability of removing said support foot from said first leg member.

25. The beverage holder of claim 14 wherein said container receptacle, said base, said leg receptacle, or said hook is separable from a connecting member or wherein any one of said first three members is separable within itself such that a major horizontal or vertical dimension of the separated assembly is reduced to simplify transport in a purse or pocket from home to a bridge game or the like.

26. In a card table having a generally plane top portion and four legs mounted to and extending from said top portion, an improved beverage holder for use in combination therewith comprising:

a generally ring-shaped beverage container receptacle connected radially to an adequate base extending to said leg; and an attachment hook extending axially upwardly from said base, said attachment hook extending upwardly to a table leg projection, over which said extension makes an approximate 90 degree turn to the left, said extension continuing around said table leg for almost 180 degrees to form a partial leg receptacle, to reach the leg support strut where the extension makes a turn upwardly to reach over the base of a strut and then makes another turn to the horizontal to pass between the table leg and support strut, and upon emerging therefrom, said attachment hook extension turning downwardly for a distance sufficient to complete the hook.

27. A food or beverage holder for mounting on a card table leg assembly comprising:

a holder;

a base extending radially away from said holder and mounted thereon;

a table leg receptacle extending radially from said base, for non-graspingly yet closely encompassing more than 180 degrees of said leg to prevent side to side or front to back movement that would cause beverage spillage and being removably mounted to said base;

at least one attachment hook extending upwardly from said leg receptacle to engage a projection from said table leg assembly; and said base being sized so that a beverage container does not touch the card table leg assembly or attachment hook during normal use.

28. A beverage holder for mounting on a card table leg assembly, comprising:

a ring-shaped beverage container receptacle;

a base extending radially away from said container receptacle and mounted thereto;

a table leg receptacle mounted to and extending radially away from said base, for non-graspingly yet closely encompassing more than 180 degrees of a table leg to prevent side to side or front to back beverage movement that would cause beverage spillage;

an attachment hook extending upwardly from said table leg receptacle for engaging a portion of the card table leg assembly; and said base being sized so that a beverage container does not touch the card table leg assembly or hook extension during normal use.

29. A beverage holder for mounting on a card table leg assembly, comprising:

a ring-shaped beverage container receptable;

a base separably mounted to said beverage container receptacle;

a table leg receptacle integrally mounted to said base which non-graspingly yet closely encompasses more than 180 degrees of a table leg to prevent side to side or front to back beverage movement that could cause beverage spillage;

an attachment hook extending upwardly from said table leg receptacle for engaging a portion of the leg assembly; and said base being sized so that a beverage container does not contact the leg assembly or hook extension during normal use.

30. A beverage holder for mounting on a card table leg assembly comprising:

a generally ring-shaped beverage container receptacle;

a base extending radially away from said container receptacle and mounted thereto;

a table leg receptacle mounted to and extending radially away from said base for non-graspingly yet closely encompassing more than 180 degrees of said table leg to prevent side to side or front to back beverage movement that would cause beverage spillage;

an attachment hook extending upwardly from said table leg receptacle and configured for engaging a slot in a slotted table leg support member; and said base being sized so that a beverage container does not touch the table leg assembly or attachment hook during normal use.

31. A beverage holder for mounting on a card table leg assembly comprising:

a generally ring-shaped beverage container receptacle;

a base extending radially away from said container receptacle and mounted thereto;

a table leg receptacle mounted to and extending radially away from said base for non-graspingly yet closely encompassing more than 180 degrees of a card table leg to prevent side to side or front to back beverage movement to prevent beverage spillage;

an attachment hook extending upwardly from said table leg receptacle along a side of said leg to a location thereon of a horizontally mounted support loop which is adapted to receive the hook within it, said hook being curved to conform to the curvature of said loop and said leg; and said base being sized so that a beverage container does not touch the table leg assembly or attachment hook during the normal use.

32. A beverage holder for mounting on a card table leg assembly comprising:

a generally ring-shaped beverage container receptacle that tapers downwardly and inwardly;

a base extending radially away from said container receptacle and mounted thereto;

a table leg receptacle mounted to and extending radially away from said base for non-graspingly yet closely encompassing more than 180 degrees of a card table leg to prevent beverage spillage;

an attachment hook extension, extending upwardly from said table leg receptacle to pass on a left side of a card table leg assembly bolt and behind a slotted support member to reach a bottom end of a support strut of said table leg on the left side of said leg and is wrapped approximately half way around and behind said leg to pass between said leg and said strut, said extension then making an approximate 90 degree turn downwardly at a right side of said strut to form a removable hook attachment on said strut; and said base being sized to prevent a container from contacting said leg assembly or an attachment hook extension during normal use.

* * * * *

UNITED STATES PATENT AND TRADEMARK OFFICE

CERTIFICATE OF CORRECTION

PATENT NO. : 5,169,108

DATED : December 8, 1992

INVENTOR(S) : Arthur E. Carlson

It is certified that error appears in the above-identified patent and that said Letters Patent is hereby corrected as shown below: On the title page: Item

[73] Assignee: delete "Arthur E. Carlson, San Diego, Calif.";

insert --Arthur E. Carlson, Trustee, UDT, August 15, 1986--

Signed and Sealed this

Twenty-sixth Day of October, 1993

*Attest:*

Bruce Lehman

BRUCE LEHMAN

*Attesting Officer*

*Commissioner of Patents and Trademarks*